United States Patent [19]

Zinger et al.

[11] Patent Number: 4,628,287

[45] Date of Patent: Dec. 9, 1986

[54] MULTIPORT RECTANGULAR $TE_{10}$ TO CIRCULAR $TE_{01}$ MODE TRANSDUCER HAVING PYRIMIDAL SHAPED TRANSDUCING MEANS

[75] Inventors: William H. Zinger; Jerry A. Krill, both of Columbia, Md.

[73] Assignee: The Johns Hopkins University, Baltimore, Md.

[21] Appl. No.: 532,892

[22] Filed: Sep. 16, 1983

[51] Int. Cl.[4] ..... H01P 1/16

[52] U.S. Cl. ..... 333/137; 333/21 R

[58] Field of Search ..... 333/21 R, 21 A, 137, 333/136, 34, 248, 239, 251, 245

[56] References Cited

U.S. PATENT DOCUMENTS

| | | | |
|---|---|---|---|
| 2,439,285 | 4/1948 | Clapp | 333/21 R |
| 2,656,513 | 10/1953 | King | 333/21 R |
| 2,825,032 | 2/1958 | Alford | 333/21 A |
| 3,150,333 | 9/1964 | Bowman | 333/34 X |
| 3,173,145 | 3/1965 | Bowman | 333/21 R X |

FOREIGN PATENT DOCUMENTS

| | | | |
|---|---|---|---|
| 1239182 | 7/1960 | France | 333/21 R |
| 470881 | 7/1975 | U.S.S.R. | 333/137 |

OTHER PUBLICATIONS

Berry, J. A., "The Development of a Wideband Transition for Rectangular $TE_{10}$ to Circular $TE_{01}$ Mode Conversion", Conference on Trunk Telecommunication, London.

*Primary Examiner*—Paul Gensler
*Assistant Examiner*—Benny T. Lee
*Attorney, Agent, or Firm*—Robert E. Archibald

[57] ABSTRACT

A method and device for transducing multiple rectangular $TE_{10}$ modes to circular $TE_{01}$ mode. Multiple $TE_{10}$ modes are transitioned into an intermediate mode which is transitioned into a circular $TE_{01}$ mode and vice versa. Unique pyramidal structure provides overmoded high power operation without cooling and/or pressurization.

6 Claims, 24 Drawing Figures

MULTIPORT RECTANGULAR $TE_{10}$ TO CIRCULAR $TE_{01}$ MODE TRANSDUCER HAVING PYRIMIDAL SHAPED TRANSDUCING MEANS

STATEMENT OF GOVERNMENTAL INTEREST

The Government has rights in this invention pursuant to Contract No. N00024-81-C-5301 awarded by the Department of the Navy.

BACKGROUND OF THE INVENTION

This invention relates generally to overmoded waveguides and more particularly to a multiport rectangular $TE_{10}$ to circular $TE_{01}$ mode transducer.

Waveguides can generally be classified as "fundamental mode" or "overmoded". A fundamental mode waveguide is designed with dimensions which support only the fundamental electromagnetic field, or mode, configuration for propagation in a given frequency band. An overmoded waveguide is designed so that several or many modes can be supported with internal structures to suppress all but the desired modal configuration. In practice, the fundamental mode waveguide, also known as the "standard" waveguide, is far more common as it is more easily designed and constructed. However, the standard waveguide is severely restricted in maximum power capacity and in minimum loss because of its required cross sectional dimensions. The advantages of an overmoded waveguide are that it can be designed to have arbitrarily high power capacity and arbitrarily low attenuation by appropriately increasing the cross section. Required suppression of unwanted modes is achieved using dielectric and metallic structures to restrict allowable modes, see "Trunk Waveguide Communication," A. E. Karbowiak, Chapman and Hall, LTD, London, 1965.

Overmoded waveguides have been utilized as telecommunications trunk transmission lines and to connect transmitters to communications or radar antennas, see "WT4 Millimeter Waveguide System: Introduction," W. D. Waters, Bell System Technical Journal, Vol. 56, No. 10, Dec. 1977, pp. 1825–1827 and "Practical Aspects of High Power Circular Waveguide Systems," R. M. Collins, NEREM Record 1962, pp. 182–183. The most common type of overmoded waveguide supports the circular $TE_{01}$ mode which has the unique property of decreasing transmission loss with increasing frequency for a given diameter, see "Trunk Waveguide Communication," A. E. Karbowiak, Chapman and Hall, LTD, London, 1965. Although applied most often to exploit the low-loss characteristic, the potential for overmoded waveguides to support higher power than standard waveguides has also been considered, see "On the Feasibility of Power Transmission Using Microwave Energy in Circular Waveguide," W. Lowenstein, Jr. and D. A. Dunn, The Journal of Microwave Power Symposium Proceedings, Part B, Vol. 1, No. 2, 1966, pp. 57–61.

Energy is generally supplied to or extracted from the desired mode in an overmoded waveguide from or by a standard waveguide via a "mode transducer". Several such mode transducers efficiently couple microwave or millimeter wavelength energy between a standard rectangular cross section waveguide $TE_{10}$ mode and the overmoded circular cross section waveguide $TE_{01}$ mode. One type of transducer involves direct transition from one mode to another through a region of gradually varying waveguide cross section. U.S. Pat. Nos. 2,859,412 to Marie, 2,779,923 to Purcell and 3,349,346 to Enderly teach this type of transducer which is generally efficient over a relatively wide frequency band.

Another type of rectangular $TE_{10}$ to circular $TE_{01}$ mode transducer is formed by providing a common wall between the rectangular and circular waveguides with modal coupling provided through holes or slots of specific separation in the common wall. Such transducers, including those taught in U.S. Pat. Nos. 2,848,690 to Miller, 3,918,010 to Marchalot and 3,369,197 to Giger, et al. provide efficient energy transfer over a more restricted bandwidth than the first type of transducer because of the particular spacing of the holes or slots relative to a guide wavelength. This bandwidth restriction can be alleviated by using special structures within the transducer, as taught by U.S. Pat. No. 2,948,864 to Miller.

Since the peak power carrying capacity of standard waveguides is generally lower than that of overmoded waveguides, the above transducers do not allow transfer of power to or from the overmoded waveguides at a level which the overmoded components are capable of supporting without substantial pressurization and cooling of the standard waveguide sections. Pressurization and temperature control are conventional methods of increasing standard waveguide power capacity, however, there are practical constraints to these methods.

The present invention teaches a device to appropriately connect multiple standard waveguides to an overmoded waveguide to increase transducer power capacity via division of power among the standard components. The U.S. Pat. No. 3,369,197 to Giger et al. teaches multiple waveguide feeds which are designed to couple to different overmoded waveguide modes or to different frequency channels but not to transfer maximum power. The present invention couples part of the geometry from the Marie transducer, U.S. Pat. No. 2,859,412 to a new section to provide a new transducer which divides power in the overmoded $TE_{01}$ mode equally among several standard rectangular waveguides consistent with the standard waveguide's power capacities. This allows efficient coupling over a relatively wide bandwidth between the circular $TE_{01}$ mode overmoded waveguide and a multiple of standard rectangular $TE_{10}$ mode waveguides without requiring pressurization. The power capacity of the transducer taught by the present invention can be increased by simply increasing the diameter of the overmoded waveguide and increasing the number of standard rectangular waveguides feeding the transducer.

It is therefore one object of this invention to provide a multiport rectangular $TE_{10}$ to circular $TE_{01}$ mode transducer.

It is another object of this invention to provide a multiport rectangular $TE_{10}$ to circular $TE_{01}$ mode transducer for overmoded waveguides.

It is a further object of this invention to provide a multiport rectangular $TE_{10}$ to circular $TE_{01}$ mode transducer for overmoded waveguides that is capable of handling high power.

It is still another object of this invention to provide a multiport rectangular $TE_{10}$ to circular $TE_{01}$ mode transducer for overmoded waveguides that is capable of handling high power without requiring pressurization or cooling.

Other objects, advantages and novel features of the present invention will become apparent from the following detailed description of the invention when considered in conjunction with the accompanying drawings.

SUMMARY OF THE INVENTION

These and other objects, features and advantages of the invention are accomplished by providing a method and device for transducing multiple rectangular $TE_{10}$ modes to a circular $TE_{01}$ mode and conversely for transducing a circular $TE_{01}$ mode to multiple $TE_{10}$ modes. A first section of the device provides or extracts multiple rectangular $TE_{10}$ modes, a second section transitions the $TE_{10}$ modes to or from an intermediate mode and a third section transitions the intermediate mode to or from a circular $TE_{01}$ mode. A unique pyramidal structure in the second section provides for the transitioning of the rectangular modes to or from the intermediate mode.

BRIEF DESCRIPTION OF THE DRAWINGS

The above and further objects and novel features of the present invention will more fully appear from the following description when the same is read in connection with the accompanying drawings. It is to be understood, however, that the drawings are for the purpose of illustration only, and are not intended as a definition of the limits of the invention.

DESCRIPTION OF THE PREFERRED EMBODIMENT

The following description of the preferred embodiment describes a four-port rectangular $TE_{10}$ to circular $TE_{01}$ mode transducer. It is to be clearly understood, however, that this invention comprehends an n-port device.

Figure 1:
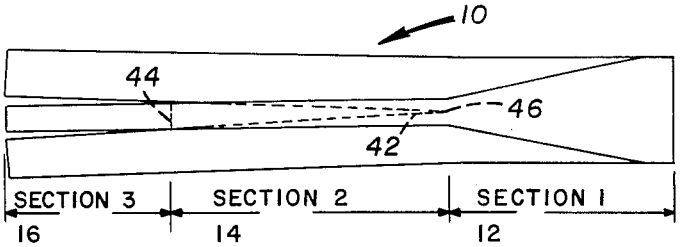
FIG. 1 is a plan view of the device as taught by the present invention shown divided into three sections.
Figure 2:
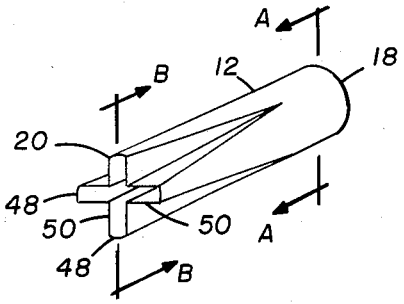
FIG. 2 shows section 1 of the present invention.
Figure 3:
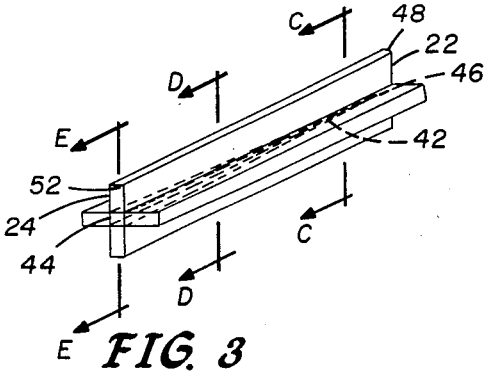
FIG. 3 shows section 2 of the present invention.
Figure 4:
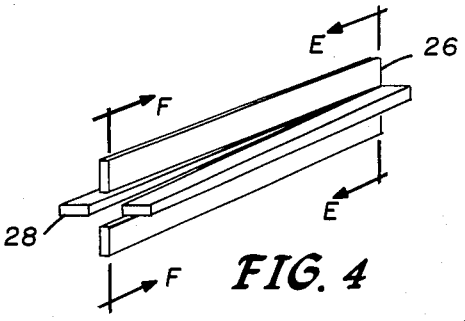
FIG. 4 shows section 3 of the present invention.
Figure 6:
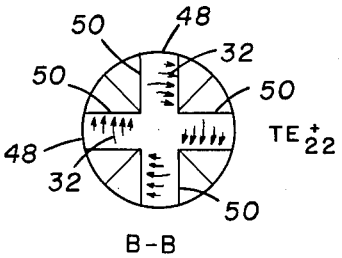
FIGS. 5 and 6 show sections AA and BB illustrated in FIG. 2.
Figure 5:
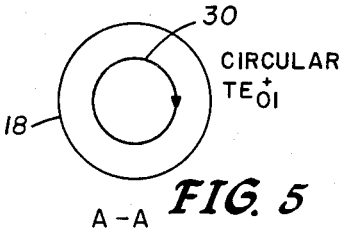
Figure 7:
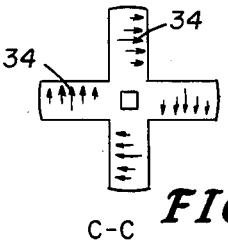
FIGS. 7 and 8 show sections CC and DD illustrated in FIG. 3.
Figure 8:
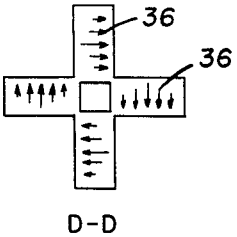
Figure 9:
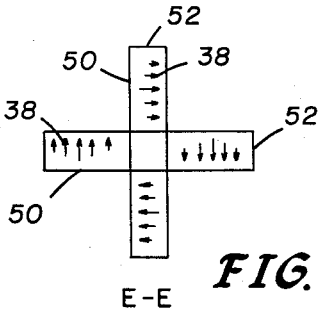
FIG. 9 shows section EE illustrated in FIGS. 3 and 4.
Figure 10:
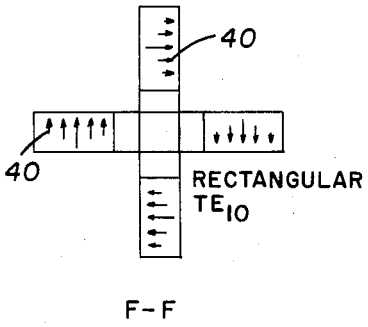
FIG. 10 shows section FF illustrated in FIG. 4.

Referring now to the drawings, FIG. 1 is a plan view of a four-port rectangular $TE_{10}$ to circular $TE_{01}$ mode transducer 10. Transducer 10 is shown divided into sections 1, 2 and 3, indicated at 12, 14 and 16 respectively and is done for purposes of illustration only. FIG. 2 shows section 1 with a cylindrical end 18 and an end 20 wherein the cylinder has been divided into four arms. It is noted that the number of arms is equal to n, the number of ports. FIG. 3 shows section 2 with an end 22 corresponding to end 20 of section 1 and a second end 24. FIG. 4 shows section 3 with one end 26 corresponding to end 24 of section 2 and an end 28. End 18 of section 1 is connected to a circular waveguide, not shown, and end 28 is connected to four individual rectangular waveguides, not shown. FIG. 5 shows section AA of FIG. 2 and arrow 30 indicates the electric field pattern. The direction of the arrows indicating the electric field pattern indicates relative polarizations and the length of the arrows indicates relative electric field strength. FIG. 6 shows section BB of FIG. 2 and arrows 32 indicate the electric field patterns. FIG. 7 shows section CC of FIG. 3 and arrows 34 indicate the electric field patterns. Similarly FIGS. 8, 9 and 10 show sections DD and EE of FIGS. 3 and 4 and arrows 36, 38 and 40 indicate electric field patterns present at each section.

Section 1, shown in FIG. 2, transforms the circular $TE_{01}$ mode, indicated by arrow 30, FIG. 5, to an intermediate mode, indicated by arrows 32, FIG. 6, and when $n=4$ the intermediate mode is a cross-shaped $TE_{22+}$. Section 2, shown in FIG. 3, converts the intermediate mode into n $TE_{10}$ modes. The n-sided pyramidal structure 42 transitions the intermediate mode into n rectangular $TE_{10}$ modes. With $n=4$ the pyramidal structure has four sides and a square base 44. The apex 46 of the pyramid is located in the center of the device at approximately the intersection of sections 1 and 2. At the apex 46 of the pyramidal structure 42 the electric field is nearly zero (on the axis) for minimal field perturbation. The outer arc-shaped boundaries, indicated at 48 in FIGS. 2 and 6, of each arm 50 gradually transition to straight waveguide walls, indicated at 52 in FIGS. 3 and 9, along the length of section 2. The transition is indicated at 49, FIG. 14. At the position indicated by cross-section EE, FIGS. 3 and 9, the base 44 of pyramid 42 has divided arms 50 into four spatially independent rectangular waveguides. In section 3, FIG. 4, the rectangular waveguides continue to separate spatially and at the position indicated by section FF in FIGS. 4 and 10, four standard rectangular waveguides are attached. With $n=8$, for example, eight standard waveguides would be attached at the position indicated by section FF.

Figure 11:
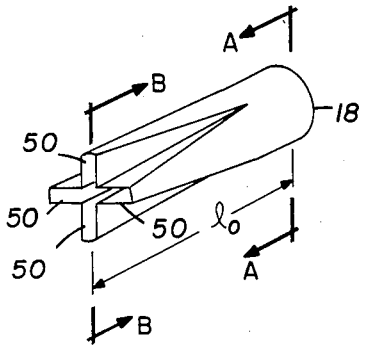
FIG. 11 shows section 1 of the present invention.
Figure 12:
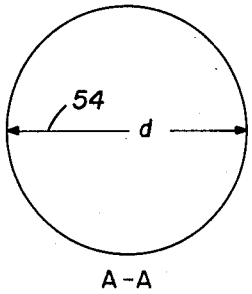
FIGS. 12 and 13 show section AA and BB illustrated in FIG. 11.
Figure 13:
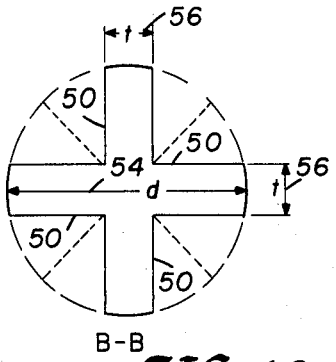

FIGS. 11–13 show detailed dimensions at selected cross sections of section 1 shown in FIG. 11. The dimensions are given in units of free space wavelengths $\lambda_o$ to allow scaling to any frequency of interest. The length $1_o$ of each section is at least $3\frac{1}{3}\lambda_o$. A nominal length of $3\frac{1}{3}\lambda_o$ is applied here as the basis for computing the cross-sectional dimensions. The inner diameter d indicated at 54 in FIGS. 12 and 13 of the overmoded circular end 18 of the transducer and the waveguide to be attached is chosen sufficiently small so that the higher order circular TE modes (i.e., $TE_{om}$, $m=2,3,\ldots$) cannot propagate. The diameter d is large enough, however, to provide low signal distortion in the $TE_{01}$ mode within about $\pm 7\%$ of the center frequency. The arms 50 at section BB, FIGS. 11 and 13, have a dimension t indicated at 56 equivalent to the rectangular waveguides to be attached at the other end of the transducer. For the design illustrated herein, conventional approximately "half-height" waveguides are used, for example, WR284, where $t=w/2=0.37\lambda_o$ where w is the waveguide cross section length.

Figure 14:
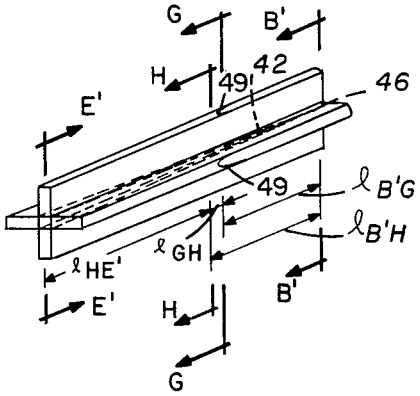
FIG. 14 shows section 2 of the present invention.
Figure 17:
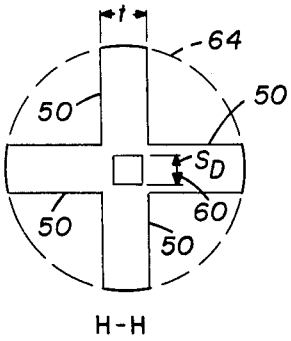

FIGS. 14–18 show the primary design features of section 2. The most important design details are the dimensions of the pyramidal structure 42 and the transition of the outer walls of arms 50 from arced, indicated at 48, FIG. 16, to straight, indicated at 52, FIG. 18. The apex 46, FIG. 15, of pyramidal structure 42 is situated on the axis of section 2 and has dimensions of $S_B=0.04\lambda_o$ on each side indicated at 53, FIG. 15, and is rounded to reduce electric field concentration to reduce arcing. In the center of section B'B' the electric field is very small and the introduction of apex 46 will not significantly change the electric field patterns. The side dimension S of the pyramidal structure 42 increases by $0.1\lambda_o$ for each $1.0\lambda_o$ increase in length from section B'B' towards section E'E'. The parameter S is determined at an arbitrary distance $1_2$ from section B'B' from the following formula:

$$S=0.1\ 1_2+0.04 \text{ (in units of } \lambda_o\text{)},$$

for example, at $S_C$ is calculated as follows:

$$S_C=0.1\ 1_{B40\ G}+0.04 \text{ (in units of } \lambda_o\text{)}$$

wherein $1_{B'G}$ is indicated in FIG. 14. Similarly, $S_D$, indicated at 60, FIG. 17, is calculated as follows:

$$S_D=0.1\ 1_{B'H}+0.04 \text{ (in units of } \lambda_o\text{)}.$$

Figure 18:
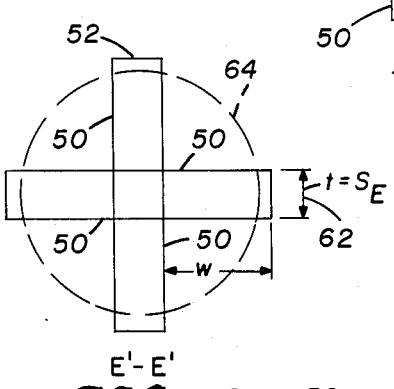

At section E'E', FIGS. 14 and 18, the cross section of pyramidal structure 42 has increased to the extent that the areas of arms 50 are spatially independent whereby four "half-height" rectangular waveguides emerge, each supporting the $TE_{10}$ mode. The sides of pyramidal structure 42 at section E'E', FIG. 18, are equal to t, as indicated at 62, FIG. 18.

Figure 15:
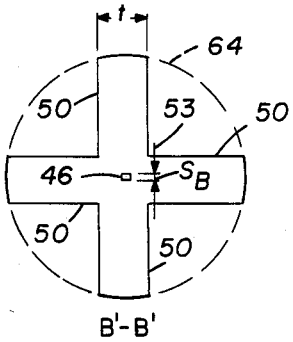
FIGS. 15–18 show sections B'B', GG, HH and E'E' illustrated in FIG. 14.
Figure 16:
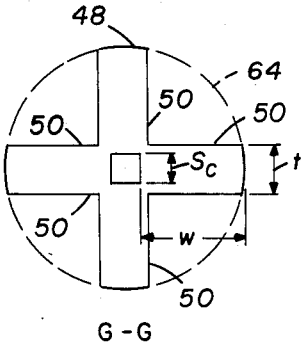

Between section B'B', FIG. 15, and section GG, FIG. 16, the cross section of pyramidal structure 42 increases without a corresponding increase in the diameter d of a circle, indicated at 64, circumscribing arms 50. In other words, the side of transverse dimension S of the pyramidal structure 42 gradually increases, in accordance with the above equation, in the direction from cross-section B'B' to cross-section G'G'; while the extending arms 50 remain at a constant cross-section (compare FIGS. 15 and 16). At section GG the length w indicated at 66, FIG. 22, between pyramidal structure 42 and the straight line connecting the ends of the arced outer wall is $w=0.793\lambda_o$. The dimension w is the long dimension of the "half-height" conventional waveguide for $t=0.374\lambda_o$.

Figure 22:
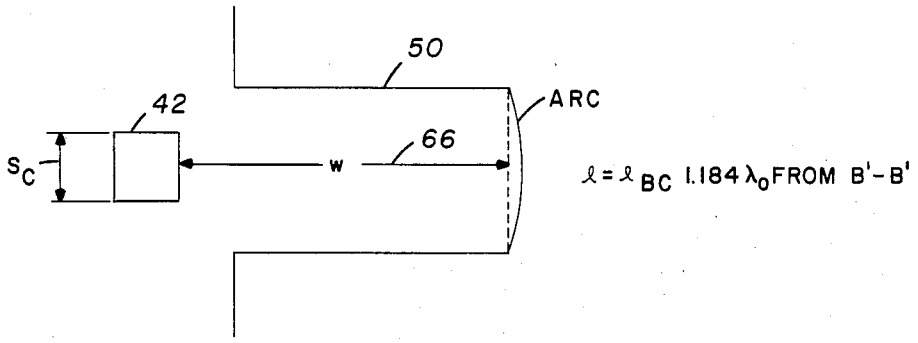
FIGS. 22–24 show dimensional details of section 2.
Figure 23:
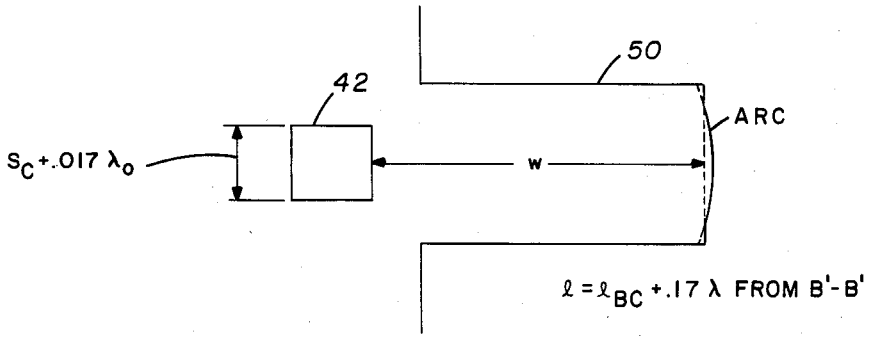
Figure 24:
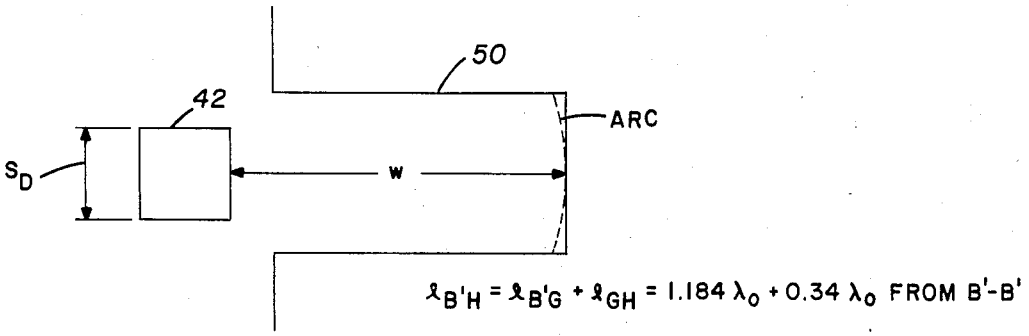

From section GG to section E'E' each arm 50 is fixed at length w from pyramidal structure 42, therefore, as the pyramidal side length S increases the transducer cross sectional length (2w+S) correspondingly increases. Between section GG and section HH, about $0.34\lambda_o$ in length, the outer wall of each of arms 50 transitions in shape from an arc of the circumscribing circle 64 of diameter d to a straight wall as indicated at 49, FIG. 14. FIGS. 22–24 illustrate the details of the transition in wall shape. FIG. 22 illustrates the outer wall shape at section GG which lies $1.18\lambda_o$ from section B'B'. FIG. 24 illustrates the straight outer wall at section HH which lies $1.18\lambda_o+0.34\lambda_o$ from section B'B'. FIG. 23 illustrates an intermediate section between section GG and section HH wherein the pyramidal side S of structure 42 is equal to $S_c+0.17\lambda_o$ and lies $1.18\lambda_o+0.17\lambda_o$ from section B'B'.

Figure 19:
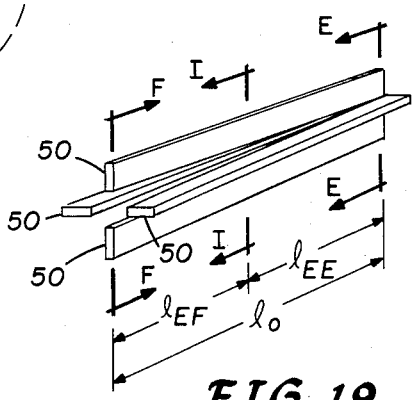
FIG. 19 shows section 3 of the present invention.
Figure 20:
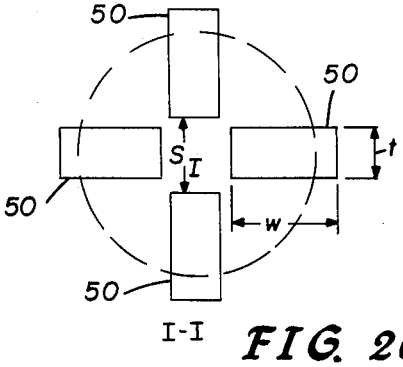
FIGS. 20 and 21 show sections II and FF illustrated in FIG. 19.
Figure 21:
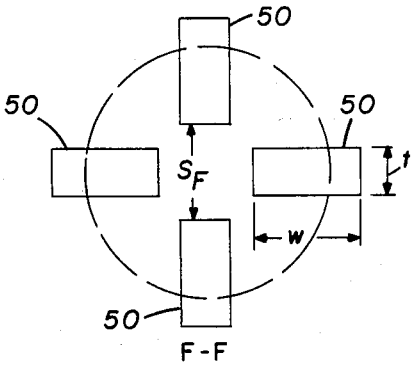

FIGS. 19–21 show detail of section 3, the purpose of which is to gradually separate the rectangular waveguide arms 50 until spacing is sufficient to allow couplers to be attached for connection to conventional waveguides. The length of this section also allows damping of any evanescent modes which might arise in the transition. The variable S is no longer interpreted as the side dimension of the cross section of pyramidal structure 42 but as the separation between the inner walls of coplanar waveguides. The formula for computing S versus length $1_3$ from section EE is:

$$S=0.1\ 1_3+0.374 \text{ (in units of } \lambda_o\text{)}.$$

Therefore, the distance $S_I$, FIG. 20, is calculated as:

$$S_I=0.1\ 1_{EE}+0.374 \text{ (in units of } \lambda_o\text{)}.$$

It is noted that a standard rectangular waveguide stepped-transform match section may be required in each arm 50 of section 3 to optimally match rectangular waveguides to the transducer.

For convenience to the reader the applicable dimensions are reproduced in Table I as follows:

TABLE I

| | |
|---|---|
| $1_o = 3\frac{1}{2}\ \lambda_o$ | $S_B = 0.04\ \lambda_o$ |
| $1_{B'G} = 1.18\ \lambda_o$ | $S_C = 0.158\ \lambda_o$ |
| $1_{GH} = 0.34\ \lambda_o$ | $S_D = 0.192\ \lambda_o$ |
| $1_{HE'} = 1.81\ \lambda_o$ | $S_E = 0.374\ \lambda_o$ |
| $1_{EE} = 1.67\ \lambda_o$ | $S_I = 0.54\ \lambda_o$ |
| $1_{EF} = 1.67\ \lambda_o$ | $S_F = 0.707\ \lambda_o$ |
| $d = 1.78\ \lambda_o$ | |
| $w = 0.793\ \lambda_o$ | |
| $t = 0.374\ \lambda_o$ | |

The above dimensions represent the best mode known at the time of filing the present patent application. While the invention has been described with reference to the accompanying drawings and associated dimensions, it is to be clearly understood that the invention is not to be limited to the particular and specific details shown herein as obvious modifications and dimensional variations may be made by those skilled in the art. The scope of the invention should only be construed within the scope of the following claims.

What we claim is:

1. A waveguide apparatus for transducing between a circular $TE_{01}$ mode and multiple (n) rectangular $TE_{10}$ modes comprising:

a first waveguide means having a circular cross section at one end thereof supporting said circular $TE_{01}$ mode and a multiple (n) arm cross section at its opposite end forming a multiplicity (n) of radially extending waveguide arm segments, each supporting an intermediate TE mode, a second waveguide means having a multiple (n) radially extending arm cross section along its length and being connected at one end to mate with said opposite end of said first waveguide means, the opposite end of said second waveguide means being formed as a multiplicity (n) of radially extending rectangular arms each open on one of its shorter sides facing the center of said second waveguide means, a pyramidal means having an apex centered within said second waveguide means adjacent to but physically disconnected from said one end of said second waveguide means and having a base centered within said second waveguide means at the opposite end of said second waveguide means, said pyramidal means having a multiplicity (n) of sides extending the length of said second waveguide means but disconnected physically from said second waveguide means except adjacent the base of said pyramidal means to close the open side of each of said multiplicity (n) of radially extending rectangular arms and complete formation of a multiplicity (n) of rectangular waveguide elements, each supporting said rectangular $TE_{10}$ mode, and a third waveguide means comprising a multiplicity (n) of separate rectangular waveguide members each supporting said rectangular $TE_{10}$ mode and each having one end connected to a respective one of the waveguide elements formed by the connection of said second waveguide means and the base of said pyramidal means.

2. The waveguide transducer apparatus specified in claim 1 wherein said first waveguide means includes an equal multiplicity (n) of wall indentation means spaced equidistant about the circumference of said first waveguide means extending longitudinally in said first waveguide means and gradually increasing in depth from said one end towards said opposite end to divide said first waveguide means into said multiplicity (n) of radially extending waveguide arm segments.

3. The waveguide transducer apparatus specified in claim 2 wherein the multiplicity (n) of wall indentation means are spaced apart by 360°/n about the circumference of the circular cross section end of said first waveguide means.

4. The waveguide transducer apparatus specified in claim 3 wherein each of said wall indentation means is formed at an angle corresponding to the supplement of the angle formed by adjacent sides of said pyramidal means, whereby each of said radially extending waveguide arms extend at a right angle to a corresponding side of said pyramidal means, and wherein the radially extending arms of said second waveguide means extend at right angles to corresponding sides of said pyramidal means along the length of said second waveguide means.

5. The waveguide transducer apparatus specified in claim 1 wherein the opposite end of each radially extending waveguide arm segment of said first waveguide means has an outer wall of arc shape and wherein each radially extending arm of said second waveguide means has an outer wall which transitions from an arc shape adjacent to its said one end corresponding to the arc shape of the outer wall of the opposite end of a respective radially extending waveguide arm segment of said first waveguide means to a straight shape at its said opposite end.

6. The waveguide transducer apparatus specified in claim 4 wherein n=4, wherein said intermediate TE mode is $TE_{22+}$ and wherein said pyramidal means has a square base to complete formation of four rectangular waveguide elements, whereby a circular waveguide supporting a circular $TE_{01}$ mode may be connected through said waveguide transducer apparatus to four separate rectangular waveguides each supporting a $TE_{10}$ mode.

* * * * *